United States Patent [19]

Horwath

[11] Patent Number: 4,967,667

[45] Date of Patent: Nov. 6, 1990

[54] METHOD AND SYSTEM FOR PREVENTING SALVAGE FUSING OF NUCLEAR ATTACK WEAPONS

[75] Inventor: Tibor G. Horwath, Stafford, Va.

[73] Assignee: Dese Research and Engineering, Inc., Huntsville, Ala.

[21] Appl. No.: 118,773

[22] Filed: Oct. 22, 1987

Related U.S. Application Data

[63] Continuation-in-part of Ser. No. 711,807, Mar. 14, 1985, abandoned.

[51] Int. Cl.[5] ..... F42B 12/32

[52] U.S. Cl. ..... 102/494; 89/1.11; 376/208; 376/909

[58] Field of Search ..... 89/1.11; 102/211, 214, 102/494; 376/208, 317, 318, 909

[56] References Cited

U.S. PATENT DOCUMENTS

| | | | |
|---|---|---|---|
| 810,582 | 1/1906 | Stout . | |
| 3,070,697 | 12/1962 | Muench | 376/208 |
| 3,309,622 | 3/1967 | Weiner et al. | 376/208 |
| 3,616,754 | 11/1971 | Frenkel . | |
| 3,761,351 | 9/1973 | Alexandrovich et al. . | |
| 4,109,883 | 8/1978 | Korr et al. | 89/8 |
| 4,211,169 | 7/1980 | Brothers . | |
| 4,388,869 | 6/1983 | Edleson . | |
| 4,555,971 | 12/1985 | Romer et al. | 89/1.11 |

FOREIGN PATENT DOCUMENTS

| | | | |
|---|---|---|---|
| 2738095 | 3/1979 | Fed. Rep. of Germany | 89/1.11 |
| 529673 | 3/1981 | U.S.S.R. | 376/208 |

OTHER PUBLICATIONS

Bethe et al., "Space-based Ballistic-Missile Defense," Scientific American, 10/84, vol. 251, No. 4, pp. 39–49.

*Primary Examiner*—Charles T. Jordan
*Assistant Examiner*—Richard W. Wendtland
*Attorney, Agent, or Firm*—Shlesinger & Myers

[57] ABSTRACT

A system for preventing salvage fusing of nuclear warhead attack weapons including an interceptor weapon having detecting means operably associated therewith for detecting an attack weapon at a predetermined distance. A disarming mechanism operably associated with the interceptor weapon for preventing detonation of the nuclear warhead. The interceptor weapon includes an explosive device for destroying the interceptor weapon during a period when the nuclear warhead is disarmed and hurling numerous particles at the attack weapon. Upon impact, the particles destroy the attack weapon thereby preventing it from ever reaching its full explosive potential.

29 Claims, 3 Drawing Sheets

METHOD AND SYSTEM FOR PREVENTING SALVAGE FUSING OF NUCLEAR ATTACK WEAPONS

FIELD OF THE INVENTION

This invention relates to a method and system for preventing salvage fusing of nuclear warhead attack weapons and the like whereby the weapons can be destroyed without causing a salvage fused nuclear explosion. This application is a continuation-in-part of U.S. patent application Ser. No. 06/711,807 filed 3/14/85 now abandoned.

BACKGROUND OF THE INVENTION

Antimissile devices have been known, such as disclosed in Korr et al, U.S. Pat. No. 4,109,883 isssued Aug. 29, 1978. Such devices propel projectiles at incoming warheads for the purpose of destroying the same prior to their reaching the target. If the enemy incorporates in its missile a mechanism which will cause salvage fusing of the missile upon impact, there will not be sufficient time for the particles to destroy the weapon prior to nuclear explosion. Even though the closing velocities of the intercept weapons or fragments impacting on the incoming warheads are in the range of 5 to 20 km. per second, they are not fast enough to prevent such nuclear explosion. The time interval between impact and the onset of significant physical damage to the warhead is in the order of several millionths of a second and thus long enough for a nuclear explosion to occur if initiated precisely at the time of impact of the interceptors or fragments. Sensing of the impact requires very little time, usually in the order of a billionth of a second, and thus the enemy can cause significant collateral damage (such as fallout, disruption of communications, and other nuclear effects) even though interception prevented his warhead from reaching its originally intended destination. Depending on the location where the intercept takes place, the collateral effects from salvage fusing could be almost as undesirable as detonation of the nuclear device on target.

OBJECTS AND SUMMARY OF THE INVENTION

It is an object of this invention to provide a method and system whereby a neutron pulse will react with the incoming nuclear warhead to cause uncontrolled or haphazard nuclear reactions detrimental to the proper functioning of the nuclear warhead, thus spoiling by disruption, the delicately timed sequence of nuclear explosion events, for a time sufficient for the impact and penetration of the fragments to complete the physical destruction of the nuclear warhead, and thus prevent nuclear explosion even though the incoming weapon is salvage fused.

It is a further object of this invention to provide a neutron reactor in an intercept weapon, which can direct missiles (fragments, pellets, particles and the like) in a specific pattern, whether forward or radially of the longitudinal axis of the intercept weapon as desired.

Another object of this invention is to provide an intercept weapon which is compact and operable at varying ranges from the attack missile.

A still further object of this invention it to provide a neutron reactor which will produce a neutron pulse for a time interval sufficient to permit missiles (fragments, particles, pellets etc.) to impact and penetrate the attack weapon to cause complete physical destruction of the same without the occurrence of a nuclear explosion.

Still a further object of this invention is to provide a neutron reactor in an intercept weapon which will generate sufficient energy to self-destruct with energy several times in excess of that obtained from a comparable weight of conventional high explosive material, but at the same time several thousand times less than the energy obtained from a nuclear explosion.

Another object of this invention is to provide a pulse or burst reactor which will accelerate missile (fragments, particles, pellets etc.) to a high velocity sufficient to penetrate conventional attack weapons and their warheads.

Still another object of this invention is to provide a neutron reactor and system for preventing salvage fusing of nuclear attack weapons which is readily manufactured and adaptable to existing or planned interceptor missile.

A further object of this invention is to provide a neutron reactor which will generate large amounts of heat, high pressure build-up in the containment case, and sufficient energy for self-destruction. The heat pressure build-up is sufficient to propel and accelerate the fragments of pellets. The ultimate result of the build-up is the self-destruction of the neutron reactor. The heat and pressure build-up, the acceleration of the fragments, etc, and the ultimate self destruction are substantially the equivalent of the process which takes place in a conventional fragmentation warhead.

Another object of this invention is to provide a method and system whereby a radio frequency signal will react with the electronic circuitry used to activate a nuclear warhead thereby destroying the same and preventing a nuclear explosion even though the incoming weapon is salvage fused.

Yet a further object of this invention is to provide a radio frequency weapon (RF weapon) which will produce a radio frequency signal for a time interval sufficient to permit missiles (fragments, particles, pellets etc.) to impact and penetrate the attack weapon to cause complete destruction of the same without the occurrence of a nuclear explosion. In summary, this invention provides a salvage fused eliminator, (SAFE) which denies the salvage fusing option to enemy nuclear weapon planners in case their weapons encounter interception by direct hit or fragmentation type interceptors.

These and other objects and advantages will be apparent from the following description and claims.

DESCRIPTION OF THE INVENTION

FIGURE

Figure 1:
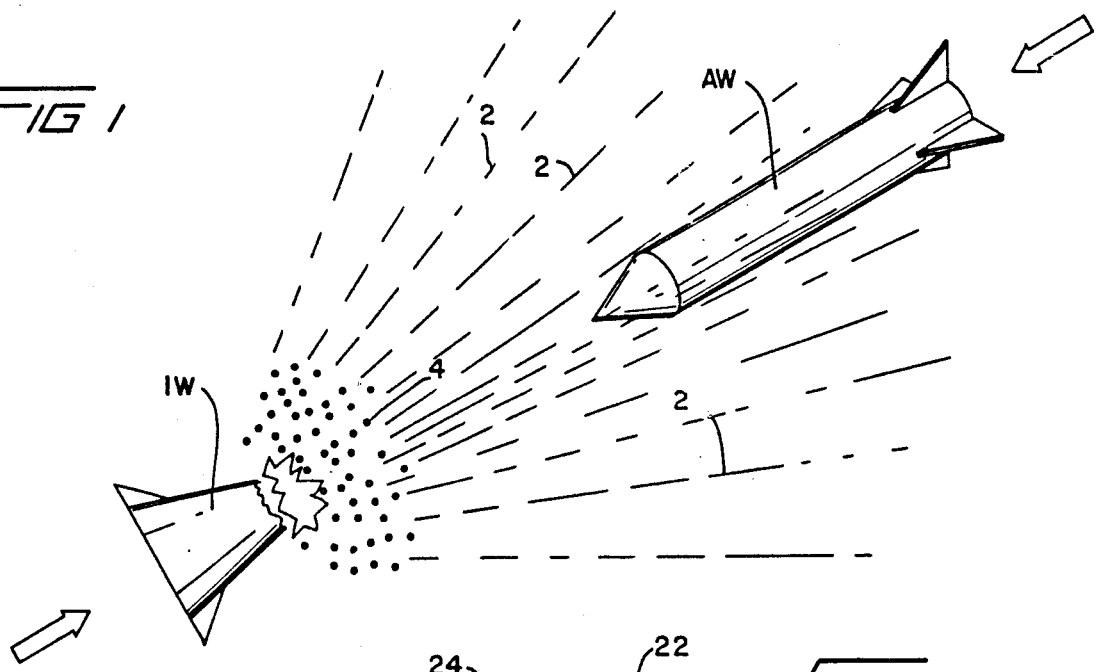
FIG. 1 is a diagrammatic view showing the intercept weapon at time of explosion in proximity to an attack weapon.

FIG. 1 shows the attack weapon AW on an incoming trajectory with the intercept weapon IW exploding at the proper range from the attack weapon AW followed by missiles (fragments, particles, pellets etc.) 4. The neutron particles 2 are released as a pulse which continues to encompass the attack weapon AW prior to impact of the missiles 4 and for a sufficient time after impact of the missiles 4 until the missiles 4 have penetrated the attack weapon AW and destroyed the same. Neutron particles react with the nuclear components of the attack weapon AW, generating sufficient energy to cause significant thermal damage to the attack weapon AW.

FIG. 2

Figure 2:
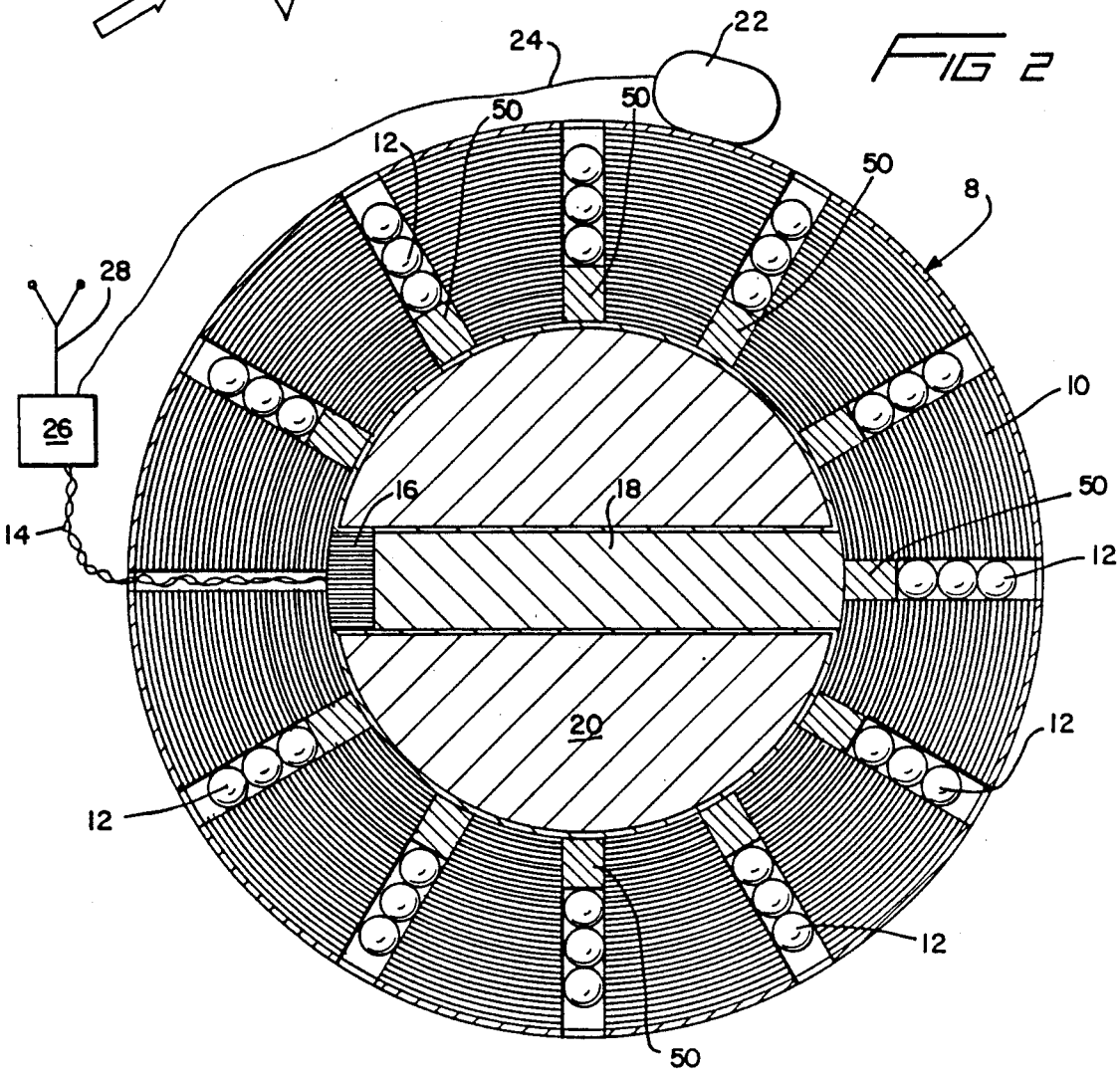
FIG. 2 is a cross-sectional view with portions of the system shown diagrammatically and attached to the neutron reactor and casings.

FIG. 2 shows the nuclear reactor 8 which includes a filament wound housing 10 incorporating therein pellets 12 and an electrical lead 14 which extends to an initiator charge 16 for compressing or driving the poison rod 18 which maintains the enriched uranium "235" 20 in a stable condition until such time as the initiator charge 16 compresses the poison rod 18 causing the nuclear reactor 8 to enter the unstable or runaway mode.

The reactor 8 contains a super critical assembly 20 of reactor fuel, usually from about 20% to 35% enriched uranium "235". Such fuel is entirely unsuitable for weapon construction. The reactor 8 is commonly known as a "pulse" reactor or "burst" reactor. It generates a copious number of neutrons and large amounts of heat. After a very short time, the nuclear reactor 8 will self-destruct because of the high pressure build-up due to the filament wound casing 10.

External of housing 10 is a second initiating neutron source 22. An electrical lead 24 operates the second neutron source. Both the leads 14 and 24 are connected to the control mechanism 26 which includes the electronic system for initiating the explosion on the initiator charge 16 and release of the neutrons from the second neutron source 22. The control mechanism 26 could include a detecting system antenna 28 or other telemetry equipment.

Figure 3:
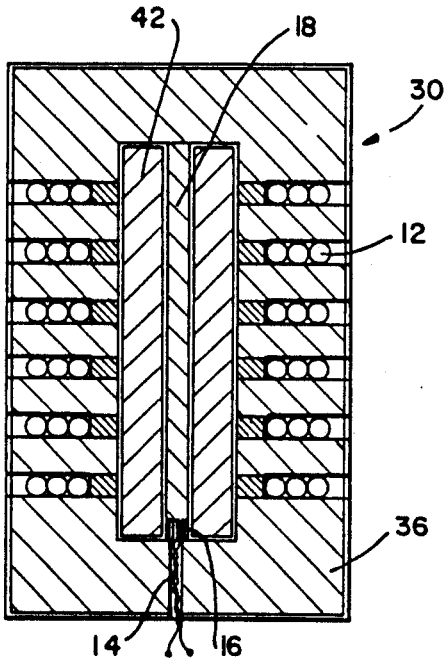
FIGS. 3, 4 and 5 show cross-sectional views of various embodiments of the neutron reactors and casings.
Figure 4:
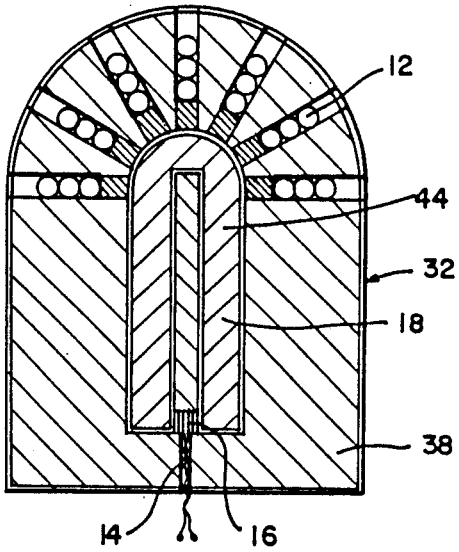
Figure 5:
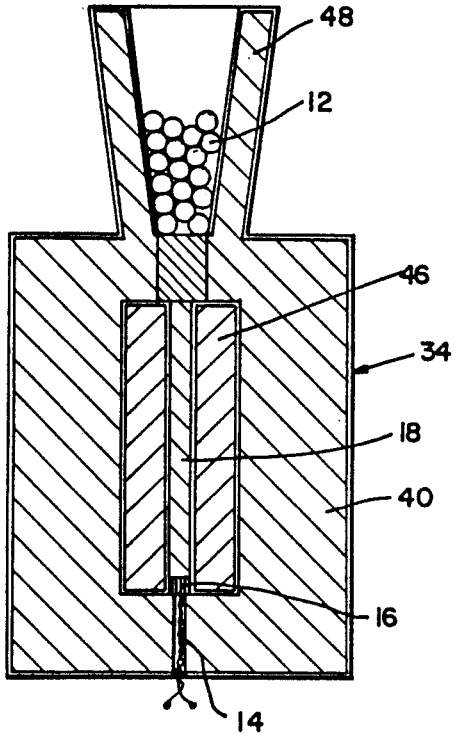

FIGS. 3, 4 and 5

FIGS. 3, 4 and 5 show various designs of neutron reactors 30, 32 and 34. Respectively, the reactors 30, 32 and 34 include filament wound housings 36, 38 and 40 incorporating pellets 12. Electrical leads 14 extend to initiator charges 16 for the poison rods 18. Enriched Uranium 235 assemblies 42, and 46 are provided in each of the respective reactors 30, 32 and 34 which will operate in the manner of the reactor 8 shown in FIG. 2. The electrical leads 14 obviously are connected to a control mechanism (not shown) which would include the detector system if necessary, for detecting the approach and range of the attack weapon AW.

Second neutron sources (not shown) would be associated with the reactors 30, 32 and 34 as in the case of the second initiating neutron source 22 in FIG. 2.

In FIG. 3, the pellets 12 are located radially of the longitudinal axis of the reactor 30 and upon self-destruction of the reactor, the pellets 12 are thrown outwardly in a Cylindrical fashion. The pellets 12 of FIG. 4 are thrown outwardly in a hemisperical pattern. The pellets 12 of FIG. 5 are projected forwardly towards the incoming attack weapon AW of FIG. 1. In FIG. 5, a horn 48 maintains the pellets 12 in position for discharge upwardly of the horn 48. Means (not shown) may be provided for maintaining the pellets 12 in position prior to self-destruction of the neutron reactor 34. Plugs 50 are provided for the missile 12. The type of plugs 50 can control the release of the missile 12, so that certain plugs 50 may blow before other plugs 50 to obtain staggered sequential bursts of missiles 12.

OPERATION

The detection of the attack weapon AW at the proper range, as determined by the electronic equipment 26, fires initiator charge 16 and which compresses the poison rod 18 to cause the enriched Uraniux "235" assembly to operate in a runaway or uncontrolled mode. Pressure will build-up in the housing 10 of the reactor 8 until self-destruction. The second initiating neutron source 22 acts as an accelerator injecting a large number of neutrons thereby speeding up the runaway or uncontrolled mode. Neutrons 22 from the runaway reaction are released and disrupt the delicately timed sequence of the nuclear explosion events of the attack weapon AW and maintain disruption from impact of the fragments 4 until physical destruction of the attack weapon AW including significant thermal damage caused by reaction of the neutrons with the nuclear components of the attack weapon AW.

A neutron pulse source which contains the reactor fuel is ⅛ to 1 cubic foot in volume, although larger assemblies could be made. This would be sufficient to generate enough energy to be several times larger than the energy obtained from a comparable weight of conventional high explosive material and several thousand times less than the energy of a nuclear explosion.

Figure 6:
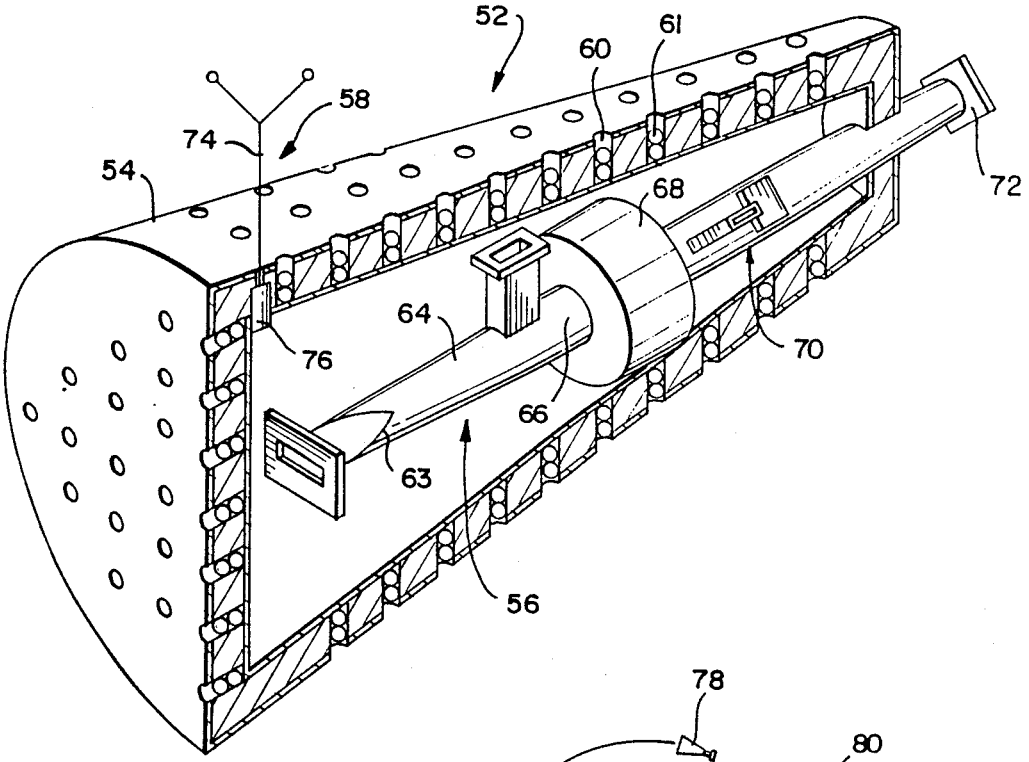
FIG. 6 is a fragmentary perspective view of an alternative embodiment of the present invention.
Figure 7:
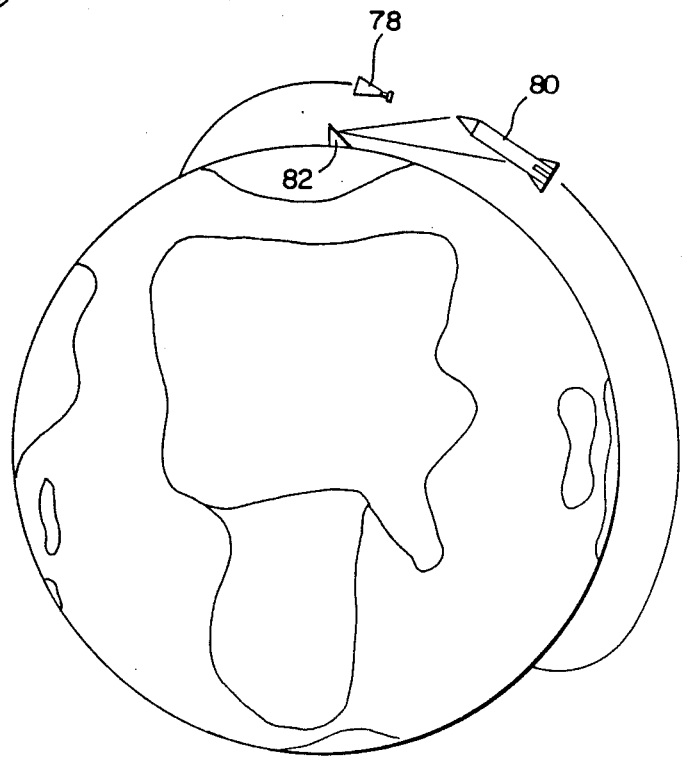
FIG. 7 is a plan view of a further embodiment of the present invention.

FIGS. 6 and 7

The alternative embodiments of the present invention shown in FIGS. 6 and 7 will now be described.

Referring to FIG. 6, an intercept weapon 52 includes a housing 54, an RF weapon 56, and a detecting mechanism 58. The housing 54 is substantially conical in shape and includes a plurality of holes 60 formed in the outer periphery thereof. A plurality of missiles 61 (fragments, particles, pellets etc.) are positioned in holes 60 formed in housing 54.

The RF weapon 56 includes an electron gun 62, a gun magnet coil 64, a main cavity 66, a main magnetic coil 68, a beam collector area 70, and an output wave guard 72.

The detecting mechanism 58 includes a detecting antenna 74 and a detecting unit 76. An activation mechanism (not shown) is operably associated with detecting mechanism 58 for energizing the radio frequency weapon 56. Further, the activating mechanism is associated with the housing 54 for exploding the same for directing the missiles 61 outwardly toward the attack weapon.

Referring to FIG. 7, a further embodiment of the invention includes an interceptor weapon 78, an attack weapon 80, and a ground radio frequency weapon 82. The intercept weapon 78, illustrated in FIG. 7, is substantially similar to the intercept weapon illustrated in FIG. 6 with the exception that the RF weapon 82 is fixed at a position on the ground.

OPERATION

FIG. 6

The operation of the embodiment of the present invention illustrated in FIG. 6 will now be described. The detection mechanism 58 will sense the approach of the attack missile AW. Subsequently, the detection mechanism 58 will relay a signal to an activating mechanism (not shown) which will energize the RF weapon 56. The electron gun 62 of the RF weapon 56 releases a number of electrons into a cylindrical chamber. The cylindrical chamber is surrounded by the gun magnet coil 64. The focusing properties and the magnetic field of the gun magnet coil 64 direct the electrons into a cyclonic motion. The electrons then enter the main cavity 66 which is surrounded by the main magnetic coil 68. The main magnetic coil 68 further alters the motion of the electrons. The electron beam is then directed to the beam collector area 70. At this point, the electrons are dissipated onto water cooled walls of the chamber thus leaving the RF signals to exit through the output wave guide 72.

RF signals subsequently are directed towards the attack weapon AW. The RF signals either render inoperative for a specified period of time or destroy the microchips used to activate the nuclear warhead in the attack weapon AW. An explosive device (not shown) is energized during the period the microchips used to activate the attack weapon AW are inoperative. The explosive device shatters housing 54 thereby directing missiles 61 at the attack weapon. The missiles 61 destroy the attack weapon thus preventing the same from reaching its full explosive potential.

The operation of the embodiment illustrated in FIG. 7 is the same as that of FIG. 6 with the exception that the RF weapon is located at a ground position.

As an alternative to the aforementioned embodiments, it is readily apparent that the housing 54 of the interceptor missile 52 could be coded with an infrared film. The infrared film would prevent the sensing unit of the attack weapon from detecting the interceptor missile. When the interceptor missile 52 reached a predetermined distance from attack weapon AW, it would explode sending missiles 61 outwardly toward the attack weapon AW. The missiles 61 would destroy the attack weapon AW prior to its reaching its full explosive potential.

Normally, the attack weapon AW's sensing unit can only detect large objects. Therefore, when the interceptor missile 62 explodes and emits numerous small particles, the warhead of the attack weapon AW will not be able to detonate.

While this invention has been described as having a preferred design, it is understood that is capable of further modifications, uses and/or adaptions of the invention following in general the principle of the invention and including such departures from the present disclosure as come within known or customary practice in the art to which the invention pertains, and is may be applied to the central features hereinbefore set forth, and fall within the scope of the invention of the limits of the appended claims.

I claim:

1. The method of limiting the explosive capability of a warhead associated with an attack missile which missile includes an antimissile detector for triggering said warhead at a specified period after detection of an intercept missile, which method prevents said warhead from reaching its full explosive potential prior to its destruction by said intercept missile which includes the steps of:

(a) providing detection means associated with said intercept missile for detecting said attack missile at a specific range from said intercept missile;

(b) providing a ray emitter operably associated with said intercept missile activated upon detection of said attack missile at said specific range and causing ray to be emitted and directed against said attack missile thereby preventing said warhead from reaching its full explosive potential after or before said attack missiles detection or said intercept missile;

(c) providing said intercept missile with bomb means;

(d) providing a firing mechanism for said bomb means;

(e) providing means for directing said bomb means against said attack missile subsequent to said rays reaching an preventing said warhead from reaching its full explosive potential;

(f) firing said bomb means;

(g) subsequently impacting said bomb means against said attack missile thereby destroying said attack missile before said attack missile reaches it full explosive potential.

2. The method of claim 1, including the step of:

(a) providing said detection means in said intercept missile.

3. The method of claim 1, including the step of:

(a) providing said detection means at a place remote from said intercept missile.

4. The method of claim 1, including the step of:

(a) providing said ray emitter in said intercept missile.

5. The method of claim 1, including the step of:

(a) providing said ray emitter at a place remote from said intercept missile.

6. The method of claim 1, including the step of:

(a) providing said intercept missile with solid particles for impacting said attack missile.

7. The method of claim 1, including the step of:

(a) sustaining said ray emission for a time interval from detection of said attack missile to destruction thereof.

8. The method of claim 6, including the step of:

(a) directing substantially all of said solid particles in all directions from said intercept missile.

9. The method of claim 6, including the step of:

(a) directing said solid particles in a generally forward direction relative to the travel of said intercept missile.

10. The method of claim 6, including the step of:

(a) directing substantially all of said missiles in an outwardly expanding cylindrical pattern from said intercept missile.

11. The method of claim 6, including the step of:

(a) directing substantially all of said missiles in an outwardly expanding hemispherical pattern.

12. The method of limiting the explosive capability of a warhead of an assault weapon which includes an antiweapon detector for triggering said warhead at a specified period after detection of an intercept means, which method prevents said warhead from reaching its full explosive potential prior to its destruction by means operably associated with said intercept means which includes the steps of:

(a) providing detection means operably associated with said intercept means for detecting said assault weapon at a specified distance from said intercept means;

(b) providing emission means operably associated with said intercept means activated upon detection of said attack weapon at said specific range and causing disarming means to be emitted and directed against said assault weapon thereby preventing said assault weapon from reaching its full explosive potential after or before detection of said intercept means by said assault weapon;

(c) providing said intercept means with bomb means;

(d) providing means for firing said bomb means;

(e) providing means for directing said bomb means against said assault weapon subsequent to said emission means reaching and preventing said warhead from reaching its full explosive potential;

(f) firing said bomb means; and (g) subsequently impacting said bomb means against said assault weapon thereby destroying said assault weapon before said assault weapon reaches its full explosive potential.

13. The method of claim 12, including the step of:

(a) providing said detection means in said intercept missile.

14. The method of claim 12, including the step of:

(a) providing said detection means at a place remote from said intercept missile.

15. The method of claim 12, including the step of:

(a) providing said emission means in said intercept missile.

16. The method of claim 12, including the step of:

(a) providing said emission means at a place remote from said intercept missile.

17. The method of claim 12, including the step of:

(a) sustaining said disarming means for a time interval from detection of said attack missile to destruction thereof.

18. A system for limiting the explosive capability of a warhead associated with an attack missile which missile includes an antimissile detector for triggering said warhead a specified period after detection of an intercept missile, including:

(a) an intercept missile;

(b) detection means operably associated with said intercept missile for detecting an attack missile at a specific range from said intercept missile;

(c) ray emitter means operably associated with said intercept missile for producing rays for preventing said attack missile from reaching its full explosive potential;

(d) means for activating said ray emitter upon detection of said attack missile at said specific range from said intercept missile;

(e) means for directing said rays at said attack missile;

(f) bomb means operably associated with said intercept missile for destroying said attack missile;

(g) means for firing said bomb means;

(h) means for directing said bomb means toward said attack missile subsequent to the activation of said ray emitter.

19. A system as in claim 18, wherein:

(a) said detection means is positioned in said intercept missile.

20. A system as in claim 18, wherein:

(a) said detection means is positioned remote from said intercept missile.

21. A system as in claim 18, wherein:

(a) said ray emitter means is positioned in said intercept missile.

22. A system as in claim 18, wherein:

(a) said ray emitter means is positioned remote from said intercept missile.

23. A system as in claim 18, wherein:

(a) said bomb means includes solid particles.

24. A system as in claim 18, wherein:

(a) said ray emitter means includes means for sustaining said ray for a time interval from detection of said attack missile to destruction thereof.

25. A system as in claim 23, wherein:

(a) said directing means includes means for directing substantially all of said solid particles in a generally forward direction relative to the travel of said intercept missile.

26. A system as in claim 23, wherein:

(a) substantially all of said solid particles radially outwardly for the longitudinal axis of said intercept missile.

27. A system as in claim 23, wherein:

(a) said directing means includes means for directing substantially all of said solid particles in a hemispherical pattern from said intercept missile.

28. A system for limiting the explosive capability of a warhead associated with an attack weapon which weapon includes an antiweapon detector for triggering said warhead a specified period after detection of an intercept weapon, including:

(a) an intercept weapon;

(b) detection means operably associated with said intercept weapon for detecting an attack weapon at a specified range from said intercept weapon;

(c) means operably associated with said intercept weapon for preventing said attack weapon form reaching its full explosive potential;

(d) means for activating said emission means upon detection of said attack weapon at said specific range from said intercept weapon;

(e) means for directing said disarming means at said attack weapon;

(f) bomb means operably associated with said intercept weapon for destroying said attack weapon;

(g) means for firing said bomb means; and (h) means for directing said bomb means toward said attack weapon subsequent to the activation of said emission means.

29. A system for limiting the explosive capability of a warhead associated with an attack weapon which weapon includes an antiweapon detector for triggering said warhead a specified period after detection of an intercept weapon, including:

(a) an intercept weapon;

(b) detection means operably associated with said intercept weapon for detecting an attack weapon at a specified range from said intercept weapon;

(c) means operably associated with said intercept weapon for disarming said attack weapon and thereby preventing the same from reaching its full explosive potential;

(d) means operably associated with said intercept weapon for destroying said attack weapon;

(e) means for activating said destroying means; and attack weapon for destroying said attack weapon prior to reaching its full explosive potential.

* * * * *